United States Patent [19]

Kunzer

[11] 4,207,558

[45] Jun. 10, 1980

[54] INTERCONNECTION CIRCUIT FOR A PLURALITY OF ALARM UNITS

[75] Inventor: John J. Kunzer, Elgin, Ill.

[73] Assignee: Pittway Corporation, Aurora, Ill.

[21] Appl. No.: 892,884

[22] Filed: Apr. 3, 1978

[51] Int. Cl.[2] ..... G08B 17/10

[52] U.S. Cl. ..... 340/524; 340/533; 340/650; 340/652

[58] Field of Search ..... 340/500, 510, 517, 521, 340/524, 531, 533, 540, 650, 651, 652, 653

[56] References Cited

U.S. PATENT DOCUMENTS

| | | | |
|---|---|---|---|
| 3,733,596 | 5/1973 | Arima | 340/533 |
| 3,821,734 | 6/1974 | Herrliberg et al. | 340/510 |
| 3,909,813 | 9/1975 | Scheidweiler et al. | 340/533 |
| 4,141,009 | 2/1979 | Fowler | 340/539 |

*Primary Examiner*—Alvin H. Waring

*Attorney, Agent, or Firm*—Vogel, Dithmar, Stotland, Stratman & Levy

[57] ABSTRACT

Each alarm unit has a sensing circuit which supplies a signal in the presence of a particular problem such as smoke, heat, or equipment failure. The signal energizes an electronic switching device, to couple power to a horn which then produces an alerting tone. The output of the sensing circuit is also coupled by a resistor to electronic switching devices in the other alarm units in the system, so that the occurrence of a problem at one location activates the horn in each alarm unit.

9 Claims, 2 Drawing Figures

INTERCONNECTION CIRCUIT FOR A PLURALITY OF ALARM UNITS

BACKGROUND OF THE INVENTION

This invention relates generally to alarm devices which sense the occurrence of a problem and produce an alarm, particularly such alarm devices designed for home use. One such device that has attracted a great deal of interest is the smoke detector, which is battery powered so as to be self-contained. The detector has a horn which emits an alerting tone.

It has been determined that several such smoke detectors should be mounted at key locations in the home. For example, one might mount a smoke detector in the upstairs hallway, another in the kitchen, another in the basement, another in the garage, etc. The occurrence of smoke exceeding some predetermined intensity will set off the alarm in the location nearest the smoke. However, the occupants may be so far from that particular alarm device that they cannot hear it. For example, if the family is sleeping, they may not hear the horn in the smoke detector located in the basement.

It has, therefore, been proposed to couple in parallel the horns of the smoke detectors such that the activation of one by smoke will automatically energize the horns in all of the detectors. Following through on the above example, smoke in the basement will set off not only the basement smoke detector, but also the detector in the upstairs hallway, thereby alerting the occupants.

The difficulty with this approach is that if a short occurs across the interconnecting pair of wires, all of the horns are disabled, including the horn in the detector which had been set off. Furthermore, the shorted horn in each smoke detector places the entire battery voltage across the switching device which may, for example, be an SCR, thereby rendering it useless. Finally, one battery—the one in the activated smoke detector—must supply current for all the horns, thereby greatly reducing its useful life.

SUMMARY OF THE INVENTION

It is, therefore, an important object of the present invention to provide an improved interconnection circuit for alarm devices such as smoke detectors.

Another object is to provide an interconnection circuit which enables each horn in each smoke detector to be set off in the presence of smoke at a single location.

Another object is to provide an interconnection circuit for a plurality of smoke detectors, such that a short in the interconnection wires will not disable the particular smoke detector being set off.

Another object is to provide an interconnection circuit for a plurality of smoke detectors, which enables each horn in each smoke detector to be set off in the presence of smoke at a single location and to be supplied with power by its associated battery.

Another object is to reduce the possibility of damage to the SCR in a smoke detector, when several such smoke detectors are interconnected.

In summary, there is provided an alarm unit adapted to be connected to at least one other alarm unit, the alarm unit having a sensing circuit adapted to supply a signal in the presence of a predetermined event, a horn and a switching device and a battery coupled in series, the switching device having a control electrode coupled to the sensing circuit, whereby the presence of an event sensed by the sending circuit renders the switching device conductive to supply current to activate the horn, the improvement comprising a terminal for connection to the one other alarm unit, and means coupled between the terminal and a point in the path between the sensing circuit and the control electrode of the switching device.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purpose of facilitating an understanding of the invention, there is illustrated in the accompanying drawings, one preferred embodiment thereof, from an inspection of which, when considered in connection with the following description, the invention, its construction, and operation, and many of its advantages should be readily understood and appreciated.

BRIEF DESCRIPTION OF THE PREFERRED EMBODIMENT

Figure 1:
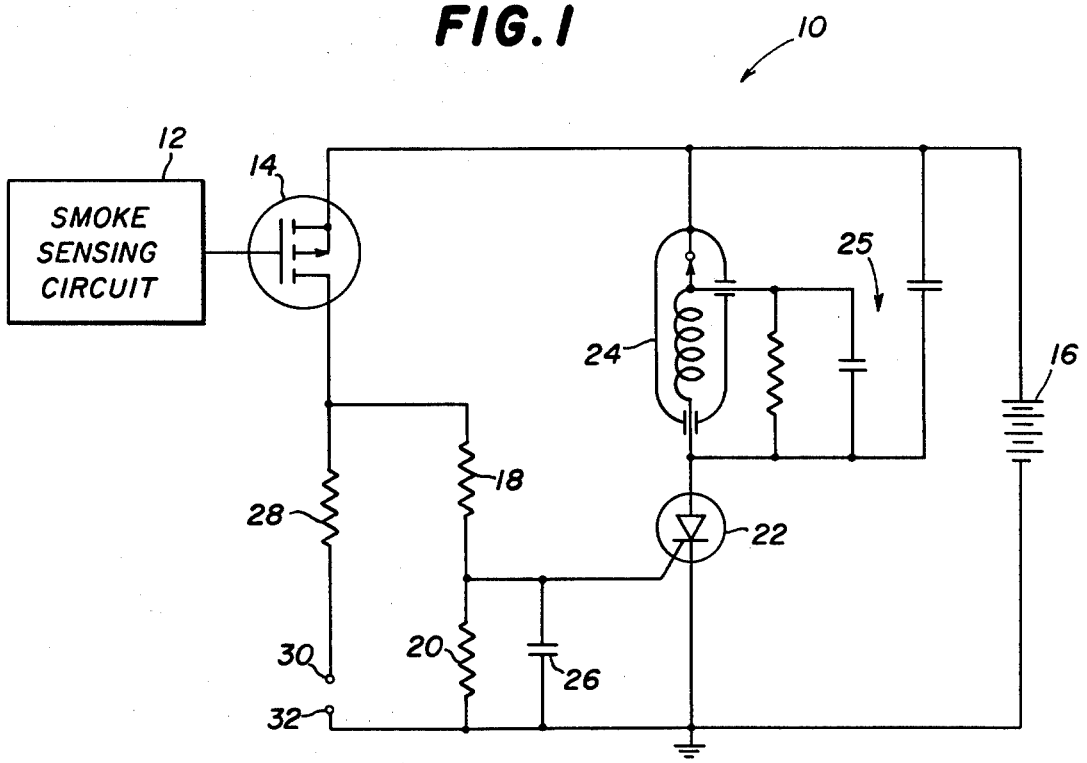
FIG. 1 is a diagram, partially in schematic and partially in block, illustrating a smoke detector incorporating the features of the present invention.

Turning now to FIG. 1, there is illustrated a smoke detector 10, although the principles of the present invention are applicable to other kinds of alarm units. The smoke detector 10 includes a smoke sensing circuit 12 which produces a signal when it senses at least a predetermined intensity of smoke. The smoke detector 10 further comprises a MOS FET 14 having its gate electrode coupled to the smoke sensing circuit 12. The source electrode of the MOS FET 14 is coupled to the positive side of a battery 16, the negative side of which is grounded. The drain electrode of the MOS FET 14 is coupled to a divider network defined by a pair of resistors 18 and 20 coupled in series. The junction of the resistors 18 and 20 is coupled to an electronic switching device such as an SCR 22, and specifically to the control electrode thereof. The cathode of the SCR 22 is connected to ground and the anode is connected through a horn 24 to the positive side of the battery 16. The smoke detector 10 also includes a noise suppression network 25 and a noise suppression capacitor 26, both connected as shown.

The detector 10 as described thus far is well known and operates as follows. When smoke near the smoke sensing circuit 12 reaches a predetermined intensity, the circuit 12 produces a signal which energizes the MOS FET 14, thereby supplying current through the resistors 18 and 20 and into the SCR 22. The SCR 22 is thereby energized, completing a circuit for current to flow through the horn 24, thereby energizing it and causing it to produce an alerting tone.

It is known to interconnect several such smoke detectors 10 so that smoke at the site of one detector would cause all the horns to emit an alerting tone. In the past, this was carried out by connecting the horns in parallel. Undesirably a short between the interconnecting wires would cause all the horns to be shorted out and none would be activated if smoke were produced at any place in the house. Even the smoke detector at the site of the smoke would not produce an alerting tone because its horn would be similarly disabled. Moreover, the battery 16, in the presence of a short, would be connected directly across the SCR 22; if during the presence of such short, the detector 10 is activated, the SCR 22 will be damaged. In addition, the battery in the smoke detector that was activated would be required to supply current to all of the horns and all of that current would have to flow through one SCR. This would reduce the useful life of the battery and require an SCR of relatively greater current handling capabilities.

The present invention enables interconnection of the smoke detectors without these adverse effects. A resistor 28 is coupled between the drain electrode of the MOS FET 14 and a terminal 30. A companion terminal 32 is connected to ground.

Figure 2:
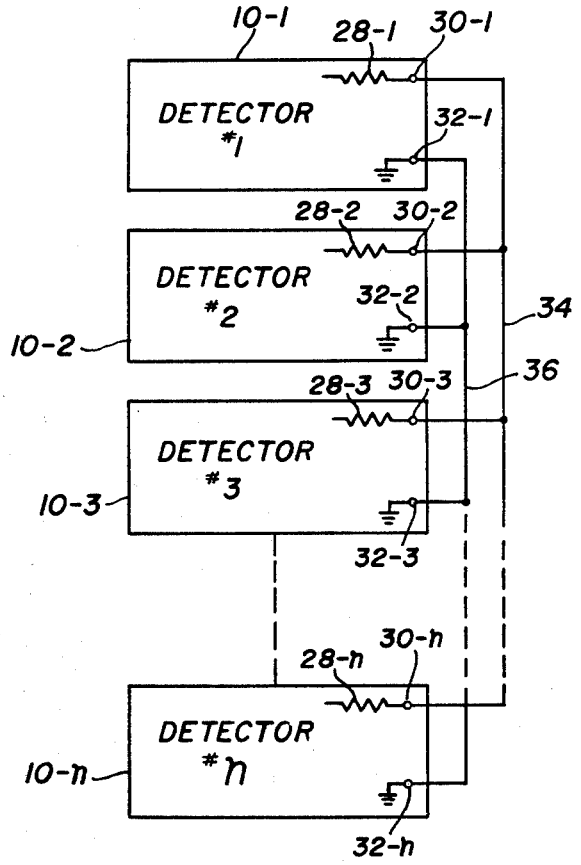
FIG. 2 is a block diagram illustrating the interconnection system of several smoke detectors.

Turning to FIG. 2, the interconnection among several smoke detectors will be described. Each smoke detector is shown in block and is labeled by the reference numeral 10 followed by a suffix identifying the particular detector. Each detector is constructed identical to the detector 10 of FIG. 1, the reference numerals for the resistor 28 and the terminals 30 and 32 being followed by the suffix identifying the associated detector. All of the terminals 30-1 through 30-n are interconnected by a conductor 34, while all of the terminals 32-1 through 32-n are interconnected by a conductor 36.

If the smoke sensing circuit in the detector 10-2, for example, senses the presence of smoke exceeding some predetermined valve, its associated MOS FET will be energized causing current to flow into the SCR 22, in turn activating the associated horn as previously described. At the same time, current is delivered through the resistor 28-2 to develop a voltage across the terminals 30-2, 32-2. The voltage thus produced across the conductors 34 and 36 appears at the corresponding terminals of all the other detectors causing the horns in all such detectors to produce an alerting tone. For example, a voltage will appear across the terminals 30-3, 32-3 thus delivering a current through the resistor 28-3 into the associated SCR, causing the associated horn to produce an alerting tone.

While the value of the resistor 28 is not critical, there are certain factors which must be considered in selecting its value. First, it must be large enough to isolate a short across the conductors 34 and 36 from the balance of the circuit in each detector. In other words, referring to FIG. 1, if a short occurs between the conductors 34 and 36, so that the terminal 30 is shorted to ground, the resistor 28 should be large enough that a signal produced by the smoke sensing circuit 12 in response to the occurrence of smoke which activates the MOS FET 14 will in turn produce sufficient current to operate the SCR 22 irrespective of the short.

On the other hand, it must be small enough so that it will not impede current provided by other smoke detectors. The selection of the resistor 28 is dependent upon the values of the resistors 18 and 20 and other details such as the value of the supply voltage produced by the battery 16, the details of the MOS FET 14 and the SCR 22, and the number of smoke detectors coupled together.

In an operating form of the invention, each of resistors 18 and 20 had a value of 10K, resistor 28 had a value of 1K, and the battery 16 produced a DC voltage of 11.2 volts (when fresh; 9.4 volts at end of useful life). The SCR 22 required at least 100 microamps through resistor 18 to become activated. In such instance resistor 28 should have a value of at least 162 ohms if resistor 18 is 1K; resistor 28 should have a value of at least 651 ohms if resistor 18 has a value of 20K; and resistor 28 must have a value of at least 2.52K if the value of resistor 18 is 50K. If ten smoke detectors 10 were to be interconnected, then resistor 28 should have a maximum value of 2.3K if resistor 18 has a value of 1K; resistor 28 should have a value of no more than 4.7K if resistor 18 has a value of 20K; and the maximum value for resistor 28 is 2K if resistor 18 has a value of 50K.

What has been described therefore is an improved interconnection circuit for alarm units which are interconnected so that the occurrence of smoke at one detector will set off all of the horns. At the same time, a short in the interconnecting conductors will not damage the SCRs nor will such short disable the particular smoke detector in the immediate area of the smoke.

I claim:

1. In an alarm unit adapted to be connected to at least one other alarm unit by a pair of wires, the alarm unit having a sensing circuit adapted to supply a signal in the presence of a predetermined event, a signalling device and a switching device and a power source coupled in series, the switching device having a control electrode coupled to the sensing circuit, whereby the presence of an event sensed by the sensing circuit renders the switching device conductive to supply current to activate the signalling device, the improvement comprising a terminal for connection to the one other alarm unit, and means coupled between said terminal and a point in the path between the sensing circuit and the control electrode of the switching device, whereby a short across the wires or an open in either of the wires will not prevent the signalling device from producing a signal in the presence of an event.

2. In the alarm unit of claim 1, wherein said means is a resistor means.

3. In the alarm unit of claim 1, and further having an FET having a gate electrode coupled to the sensing circuit and a drain electrode coupled to the control electrode of the switching device, said means being coupled to the drain electrode.

4. In the alarm unit of claim 1, and further having a voltage divider coupled between the sensing circuit and the switching device, said means being coupled to said voltage divider.

5. A system of alarm units interconnected by pairs of wires, each alarm unit including a sensing circuit adapted to supply a signal in the presence of a problem, a signalling device and a switching device and a power source coupled in series, said switching device having a control electrode coupled to said sensing circuit, and means coupled to a point in the path between said sensing circuit and the control electrode of said switching device; the means in each alarm being coupled to a common point, whereby a short across any pair of wires or an open in any of the wires will not prevent the signalling device of an alarm unit in the vicinity of an event from producing a signal in response to such event.

6. The system of claim 5, wherein the means in each unit is a resistor means.

7. In the alarm unit of claim 1, wherein the signalling device is a horn.

8. In the alarm unit of claim 1, wherein the power source is a battery.

9. In a self-contained alarm unit adapted to be connected to at least one other self-contained alarm unit by a pair of wires, the alarm unit having a sensing circuit adapted to supply a signal in the presence of a predetermined event, a signalling device and a switching device and a power source coupled in series, the switching device having a pair of electrodes for receiving a signal to control conduction of said switching device and being coupled to the sensing circuit, whereby the presence of an event sensed by the sensing circuit renders the switching device conductive to supply current to activate the signalling device, the improvement comprising a pair of terminals for connection to the one other alarm unit, one of said terminals being coupled to one of said electrodes, and means coupled between the other of said terminals and the other of said electrodes, whereby a short across the wires or an open in either of the wires will not prevent the signalling device from producing a signal in the presence of an event.

* * * * *